US010826181B2

(12) United States Patent
Wolf

(10) Patent No.: US 10,826,181 B2
(45) Date of Patent: Nov. 3, 2020

(54) HYBRID PATCH ANTENNAS, ANTENNA ELEMENT BOARDS AND RELATED DEVICES

(71) Applicant: Sensus Spectrum, LLC, Morrisville, NC (US)

(72) Inventor: Kevin Matthew Wolf, Durham, NC (US)

(73) Assignee: Sensus Spectrum, LLC, Morrisville, NC (US)

( * ) Notice: Subject to any disclaimer, the term of this patent is extended or adjusted under 35 U.S.C. 154(b) by 389 days.

(21) Appl. No.: 15/646,463

(22) Filed: Jul. 11, 2017

(65) Prior Publication Data

US 2019/0020113 A1 Jan. 17, 2019

(51) Int. Cl.

| | |
|---|---|
| ***H01Q 9/04*** | (2006.01) |
| ***H01Q 1/38*** | (2006.01) |
| ***H01Q 1/22*** | (2006.01) |
| ***H01Q 5/40*** | (2015.01) |

(52) U.S. Cl.

CPC ..... *H01Q 9/0421* (2013.01); *H01Q 1/2233* (2013.01); *H01Q 1/38* (2013.01); *H01Q 9/0407* (2013.01); *H01Q 9/0414* (2013.01); *H01Q 9/0442* (2013.01); *H01Q 5/40* (2015.01)

(58) Field of Classification Search

CPC ..... H01Q 1/2233; H01Q 9/0407

See application file for complete search history.

(56) References Cited

U.S. PATENT DOCUMENTS

| | | | | |
|---|---|---|---|---|
| 5,231,407 | A | 7/1993 | McGirr et al. | |
| 5,442,366 | A | 8/1995 | Sanford | |
| 5,808,285 | A | 9/1998 | Rockstein et al. | |
| 5,943,016 | A | 8/1999 | Snyder, Jr. et al. | |
| 6,115,677 | A | 9/2000 | Perthold et al. | |
| 6,400,321 | B1 | 6/2002 | Fenwick et al. | |
| 6,414,637 | B2 * | 7/2002 | Keilen | H01Q 1/243 343/700 MS |
| 6,961,544 | B1 * | 11/2005 | Hagstrom | H01Q 1/243 343/702 |
| 7,903,035 | B2 | 3/2011 | Mikkola et al. | |
| 8,159,401 | B2 | 4/2012 | Hao et al. | |

(Continued)

FOREIGN PATENT DOCUMENTS

| | | |
|---|---|---|
| KR | 10-2011-0042001 A | 4/2011 |
| WO | WO 90/13152 | 11/1990 |

OTHER PUBLICATIONS

Chen et al., PIFA With a Meandered and Folded Patch for the Dual-Band Mobile Phone Application, IEEE Transactions on Antennas and Propagation, vol. 51, No. 9, Sep. 2003, pp. 2468-2471.

(Continued)

*Primary Examiner* — Dimary S Lopez Cruz

*Assistant Examiner* — Amal Patel

(74) *Attorney, Agent, or Firm* — Stanek Lemon Crouse & Meeks, P.A.

(57) ABSTRACT

A hybrid patch antenna assembly is provided including an antenna element board having first and second layers separated by a dielectric and a radio board coupled to the antenna element board by at least two legs of a ladder line and separated from the antenna element board by a predetermined distance such that the antenna element board is suspended above the radio board.

17 Claims, 6 Drawing Sheets

(56) References Cited

U.S. PATENT DOCUMENTS

| | | | | |
|---|---|---|---|---|
| 8,264,415 | B2 | 9/2012 | Winkler et al. | |
| 9,601,831 | B2 * | 3/2017 | Watanabe | H01Q 1/48 |
| 2007/0120740 | A1 | 5/2007 | Iellici et al. | |
| 2014/0266939 | A1 | 9/2014 | Baringer et al. | |

OTHER PUBLICATIONS

International Search Report and Written Opinion, PCT/US2018/017033, dated Apr. 26, 2018, 20 pages.
Notification Concerning Transmittal of International Preliminary Report on Patentability, PCT/US2018/017033, dated Jan. 14, 2020, 13 pages.

* cited by examiner

HYBRID PATCH ANTENNAS, ANTENNA ELEMENT BOARDS AND RELATED DEVICES

FIELD

The present inventive concept relates generally to antennas and, more particularly, to antennas suitable for use in power meters.

BACKGROUND

Antennas are used in smart meters so meters can communicate with a remote location. For example, smart meters can measure customer usage of, for example, energy, water or gas, and transmit customer usage directly to the utility, possibly eliminating the practice of estimated bills. Thus, smart meters may provide near-real time usage information about how much, when and in some cases, at what price, a customer uses energy, water or gas. Smart meters work as a part of a smart grid and, therefore, provide improved outage detection and notification. Some smart meters can electronically report the location of outages before a call to the utility is made by a customer, making restoration faster and status notification much easier.

Having integrated antennas in the meter itself allows the meter to have this "smart" capability. However, as meters become smaller and more compact, providing an antenna with good efficiency in the smaller housing becomes a challenge.

SUMMARY

Some embodiments of the present inventive concept provide a hybrid patch antenna assembly including an antenna element board comprising first and second layers separated by a dielectric; and a radio board coupled to the antenna element board by at least two legs of a ladder line and separated from the antenna element board by a predetermined distance such that the antenna element board is suspended above the radio board.

In further embodiments, the first layer of the antenna element board may include an active antenna element and the second layer of the antenna element board may include an antenna ground, the active antenna element and the antenna ground being integrated into a single printed circuit board. The first and second layers of the antenna element board may include copper and the dielectric may include FR4.

In still further embodiments, the hybrid patch antenna may resonate at a frequency of from about 450 MHz to about 460 MHz.

In some embodiments, a change in the predetermined distance between the antenna element board and the radio board may change parameters of the hybrid patch antenna.

In further embodiments, the ladder line may be configured to be a controlled impedance transmission line.

In still further embodiments, a distance between legs of the ladder line and a location of an antenna feed may define an impedance of an antenna feed.

In some embodiments, a first leg of the ladder line may be an active feed and electrically couple the first layer of the antenna element board. A second leg of the ladder line may electrically couple the radio board to the second layer of the antenna element board.

In further embodiments, the antenna element board may define a cutout therein.

In still further embodiments, the hybrid patch antenna may have a width W of from about 59 mm to about 69.5 mm; a length L of from about 100.5 mm to about 103.7 mm; and a depth D1 of from about 16 mm to about 35 mm.

In some embodiments, the hybrid patch antenna may be absent any parasitic lumped elements configured to artificially lower a resonance of the hybrid patch antenna.

In further embodiments, the antenna assembly may be positioned in a power meter.

Still further embodiments of the present inventive concept provide a smart power meter comprising a hybrid patch antenna assembly. The hybrid patch antenna assembly includes an antenna element board comprising first and second layers separated by a dielectric; and a radio board coupled to the antenna element board by at least two legs of a ladder line and separated from the antenna element board by a predetermined distance such that the antenna element board is suspended above the radio board.

Some embodiments of the present inventive concept provide an antenna element board including first and second layers separated by a dielectric. The first layer of the antenna element board includes an active antenna element and the second layer of the antenna element board includes an antenna ground. The active antenna element and the antenna ground are integrated into a single printed circuit board.

In further embodiments, the first and second layers of the antenna element board may include copper and the dielectric may include FR4.

In still further embodiments, the antenna element board may be suspended above a radio board by a predetermined distance.

In some embodiments, the radio board may be coupled to the antenna element board by at least two legs of a ladder line.

In further embodiments, a first leg of the ladder line may be an active feed and electrically couple the first layer of the antenna element board. A second leg of the ladder line may electrically couple the radio board to the second layer of the antenna element board.

DETAILED DESCRIPTION

Figure 1:
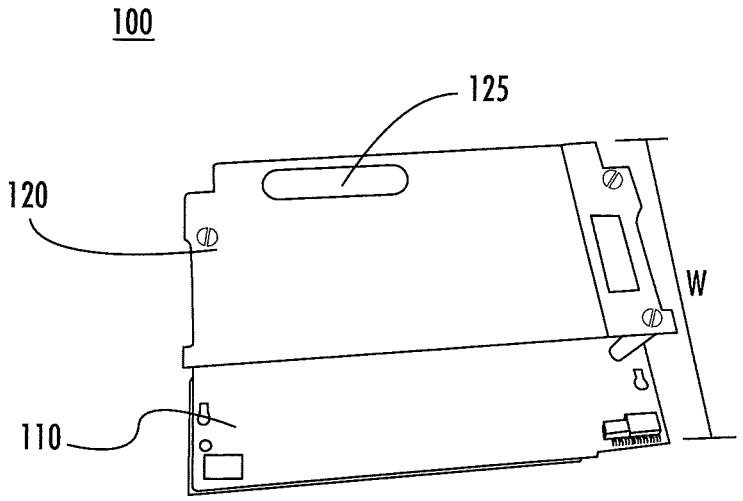
FIG. 1 is a perspective view of an antenna assembly in accordance with some embodiments of the present inventive concept.

The present inventive concept will be described more fully hereinafter with reference to the accompanying figures, in which embodiments of the inventive concept are shown. This inventive concept may, however, be embodied in many alternate forms and should not be construed as limited to the embodiments set forth herein.

Accordingly, while the inventive concept is susceptible to various modifications and alternative forms, specific embodiments thereof are shown by way of example in the drawings and will herein be described in detail. It should be understood, however, that there is no intent to limit the inventive concept to the particular forms disclosed, but on the contrary, the inventive concept is to cover all modifications, equivalents, and alternatives falling within the spirit and scope of the inventive concept as defined by the claims. Like numbers refer to like elements throughout the description of the figures.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises", "comprising," "includes" and/or "including" when used in this specification, specify the presence of stated features, integers, steps, operations, elements, and/or components, but do not preclude the presence or addition of one or more other features, integers, steps, operations, elements, components, and/or groups thereof. Moreover, when an element is referred to as being "responsive" or "connected" to another element, it can be directly responsive or connected to the other element, or intervening elements may be present. In contrast, when an element is referred to as being "directly responsive" or "directly connected" to another element, there are no intervening elements present. As used herein the term "and/or" includes any and all combinations of one or more of the associated listed items and may be abbreviated as "/".

Unless otherwise defined, all terms (including technical and scientific terms) used herein have the same meaning as commonly understood by one of ordinary skill in the art to which this inventive concept belongs. It will be further understood that terms used herein should be interpreted as having a meaning that is consistent with their meaning in the context of this specification and the relevant art and will not be interpreted in an idealized or overly formal sense unless expressly so defined herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure. Although some of the diagrams include arrows on communication paths to show a primary direction of communication, it is to be understood that communication may occur in the opposite direction to the depicted arrows.

As discussed in the background, having integrated antennas in the meter itself allows the meter to have this "smart" capability. However, as meters become smaller and more compact, providing an antenna with good efficiency at low frequencies in the smaller housing becomes a challenge. Thus, embodiments of the present inventive concept provide an antenna assembly including a radio board and an antenna element board having dimensions suitable for placement in a meter and still operating at assigned frequencies, for example, 451 or 461 MHz, as will be discussed further below with respect to FIGS. 1 through 9.

Referring first to FIG. 1, an antenna assembly in accordance with embodiments of the present inventive concept will be discussed. As illustrated therein, the antenna assembly 100 includes both a radio board 110 and an antenna element board 120. The entire assembly including the radio board 110 and the antenna element board 120 are part of full antenna structure. In some embodiments, the entire assembly has a total width W of about 67.00 mm and a total length L of about 103.6 mm. A radio board ground plane acts as "counterpoise" to a monopole antenna element in some embodiments. In some embodiments, both the radio board 110 and the antenna element board 120 are multi-layer printed circuit boards (PCBs). However, in some embodiments, the boards may not be PCBs. For example, in some embodiments, a board may be provided by a piece of sheet metal or solid metal body that may or may not be stamped. As will be discussed further below, in embodiments where the boards are provided by PCBs, the two PCBs are fed via a ladder line electrically coupling the two PCBs. Embodiments of the present inventive concept combine characteristics of both a planar inverted F antenna (PIFA) and a PCB patch antenna. Combining the two types of antennas provides a "hybrid patch antenna" in accordance with embodiments of the present inventive concept. One of the resonances of the hybrid patch antenna discussed herein occurs at a much lower frequency than a patch or PIFA antenna of similar volume, which demonstrates an improved volume-to-radiation efficiency ratio at operating frequency. For example, some of the antennas in accordance with embodiments discussed herein exhibit operating frequencies of 451 or 461 MHz.

Figure 2:
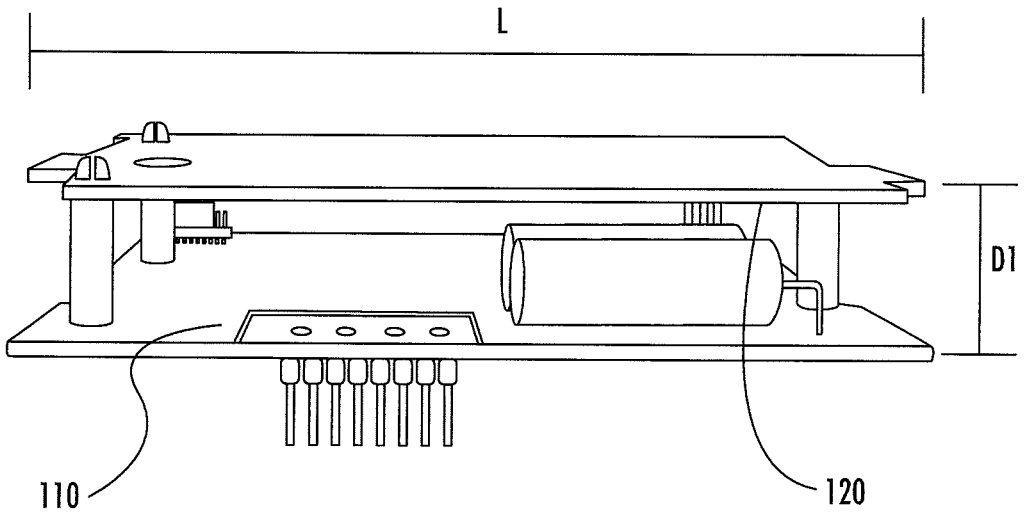
FIG. 2 is a first side view of the antenna assembly in accordance with some embodiments of the present inventive concept.

Referring to FIGS. 1 and 2, in some embodiments, the antenna assembly 100 may have a total width W of from about 59 mm to about 69.5 mm and length L of from about 100.5 mm to about 103.7 mm. As further illustrated in FIG. 2, a distance D1 between the radio board 110 and the antenna element board 120 may be from about 16 mm to about 35 mm. The relatively small footprint of the antenna assembly 100 allows the antenna assembly to be positioned in the meter such that the meter is "smart" and can communicate usage information to a remote location.

As illustrated in FIG. 2, the antenna board 120 is suspended above the radio board 110 and, as discussed above, is electrically connected via a ladder line. As discussed above, the radio board 110 and the antenna board 120 are separated by a distance D1. The distance D1 between the radio board 110 and the antenna board 120 can be adjusted to achieve desired parameters of the antenna. For example, adjusting the distance D1 may allow parameters such as radiation pattern and resonant frequency to be adjusted. The radio board 110 may be any suitable radio board capable of providing the necessary functions in accordance with embodiments discussed herein.

Figure 3A:
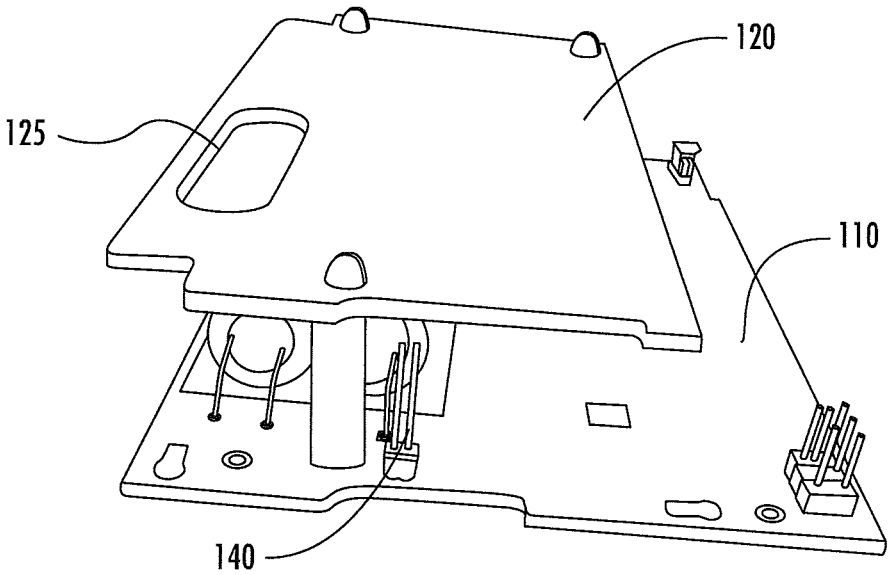
FIG. 3A is second side view of the antenna assembly illustrating a ladder line in accordance with some embodiments of the present inventive concept.
Figure 3B:
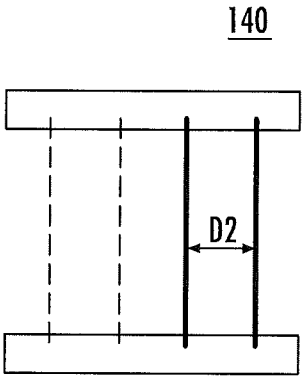
FIG. 3B is a block diagram of the ladder line of FIG. 3A illustrating details thereof.

Referring now to FIGS. 3A and 3B, as discussed above, the antenna board 120 and the radio board 110 are coupled by a ladder line 140. In some embodiments, the ladder line 140 acts as a controlled impedance transmission line. A distance D2 (FIG. 3B) between ladder line legs defines an impedance at the antenna feed point (looking into ladder lines). In some embodiments, the distance D2 between the ladder line legs is about 0.05 inches, which has a corresponding impedance at the antenna feed point of about 50 ohms. It will be understood that these dimensions and impedances are provided as an example only and embodiments of the present inventive concept are not limited to this configuration.

In some embodiments, a first leg of the ladder line is active feed, and is configured to electrically connect to a top layer of antenna assembly 100. In these embodiments, a second leg of ladder line electrically connects the radio board ground plane with the ground layer of antenna board. In embodiments illustrated in FIGS. 3A and 3B, a ladder line 140 includes a total of four legs, and the third and fourth legs are passive (as indicated by the dotted lines in FIG. 3B) and only provide mechanical support. However, embodiments of the present inventive concept are not limited to this configuration.

As illustrated in FIGS. 1 and 3A, a cutout 125 is provided on the antenna element board 120. This cutout 125 is provided as a mechanical keep out. Slots of this fashion can be used, however, to make the hybrid patch antenna operate over multiple bands. The cut out 125 may also facilitate physically positioning the hybrid patch antenna into a meter.

As discussed above, the hybrid patch antenna in accordance with embodiments discussed herein combines features of a PIFA antenna and a patch antenna. In particular, the hybrid patch antenna in accordance with embodiments discussed herein is physically similar to a PIFA antenna because the antenna element is fed from one end, and two complimentary feed lines are used to provide a form of impedance matching. Furthermore, an active element of the antenna "floats" above the radio ground plane for capacitive coupling, which aids in lowering antenna resonance.

The hybrid patch antenna in accordance with some embodiments is physically similar to a patch antenna because the active patch element (top layer) is positioned on a ground plane and is separated by a dielectric, for example, a standard FR4 PCB material. Conventionally, the patch element would be positioned above a ground plane physically much larger than the element itself. The element would be fed in the center of the patch or fed into the center of one of the sides, slightly offset to feed into an optimal impedance match.

Simulations of the hybrid patch antenna discussed herein were run and two primary resonances were observed. In some embodiments, it is assumed the lower resonance is the antenna operating as a patch antenna, and is primarily a function of the interaction with the higher-than-air $\varepsilon r$ PCB substrate. The higher resonance, which does not appear to radiate effectively, is assumed to be the antenna resonating (also as a patch antenna), but as a function of the interaction with air as a dielectric.

Figure 4:
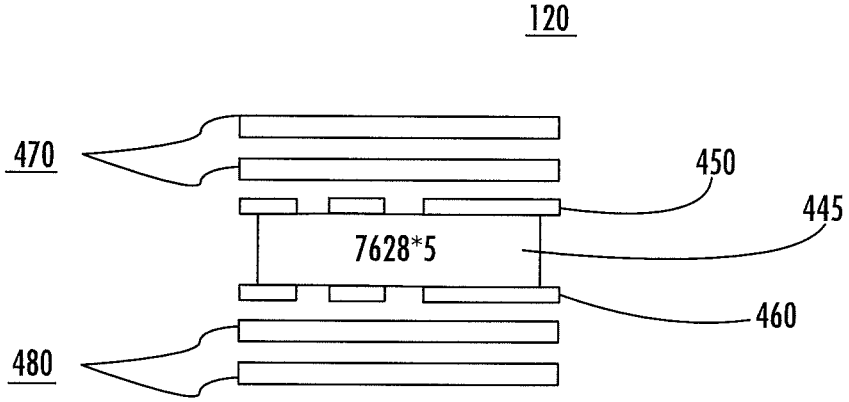
FIG. 4 is a cross section of the antenna board illustrating a stack up of the layers therein in accordance with some embodiments of the present inventive concept.

Referring now to FIG. 4, a cross section (stack up) of the antenna element board 120 will be discussed. As illustrated in FIG. 4, the antenna element board 120 is provided including a dielectric material 445, for example, FR4 and may have a thickness of about 0.0548 inches. First 450 and second 460 copper (Cu) layers are provided on first and second surfaces of the antenna dielectric material 445, respectively. The first and second copper layers 450 and 460 may have similar thicknesses or different thicknesses, but in some embodiments may both have a thickness of about 0.0020 inches. It will be understood that these materials and/or thicknesses are provided as examples only and embodiments of the present inventive concept should not be limited to those discussed herein. For example, the dielectric material (FR4) can change, based on the parameters the designer desires. FR4 is a common material based on price and the fact that it supports sub-GHz radio frequency (RF) assemblies reasonably well. Furthermore, thicknesses of the first and second copper layers may vary. A difference in copper thickness would not be very critical to antenna performance. However, altering the thickness of the antenna board (core) has a direct correlation to antenna resonance. As further illustrated in FIG. 4, a silkscreen and solder mask 470 and 480 may be provided on surfaces of both copper layers 450 and 460, respectively.

Thus, the antenna assembly 100 in accordance with embodiments of the present inventive concept includes three layers. An active antenna element and an antenna ground both in the antenna element board 120 and a radio board ground plane 110. No parasitic elements are required to artificially lower the antenna resonance, which reduces the cost and difficulty of manufacture.

Hybrid patch antennas in accordance with some embodiments of the present inventive concept provide good performance for antennas having such a small footprint, i.e. small enough to be received inside a meter, and volume, when compared to conventional monopole, dipole, PIFA or patch antennas at these low frequencies. As a general rule of thumb, resonant frequency is very closely coupled with volume, and more specifically element area Length multiplied by width (L*W) when dealing with PIFAs. Embodiments of the present inventive concept do not use any parasitic lumped elements to artificially lower antenna resonance, which makes the antenna assembly in accordance with embodiments discussed herein relatively easy to manufacture.

Antenna assemblies in accordance with embodiments discussed herein provide a unique design. As discussed above, the antenna element 120 has an elevated feed coupling into a top layer, and ground layer on a single PCB of a certain material and dielectric constant. Thus, allowing substantial radiation efficiency and matching efficiency to be achieved in a small volume. The number of decibels (dBs) directly correlates to distance.

Figure 5:
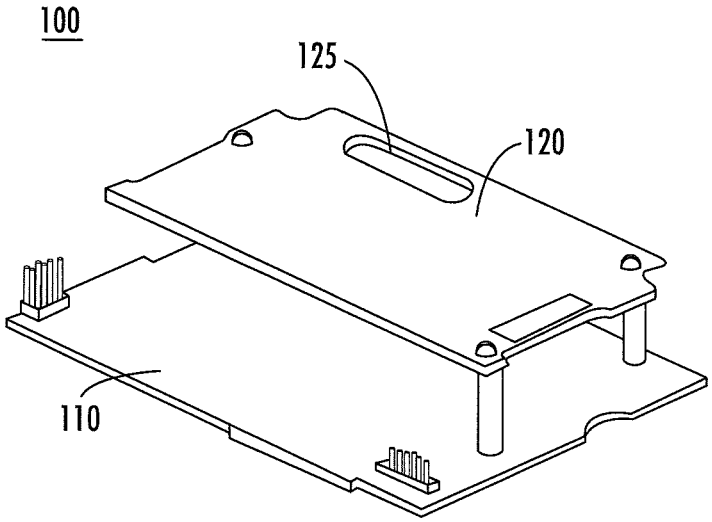
FIG. 5 is a diagram illustrating a perspective view of a hybrid patch antenna in accordance with some embodiments of the present inventive concept.

Various views of an antenna assembly 100 in accordance with some embodiments of the present inventive concept will now be discussed. Referring first to FIG. 5, a diagram illustrating a perspective view of an antenna assembly 100 in accordance with some embodiments of the present inventive concept will be discussed. As illustrated, the antenna assembly 100 includes a radio board 110 and an antenna element board 120. As further illustrated in FIG. 5, the antenna element board 120 may include a cut out 125 as discussed in detail above.

Figure 6:
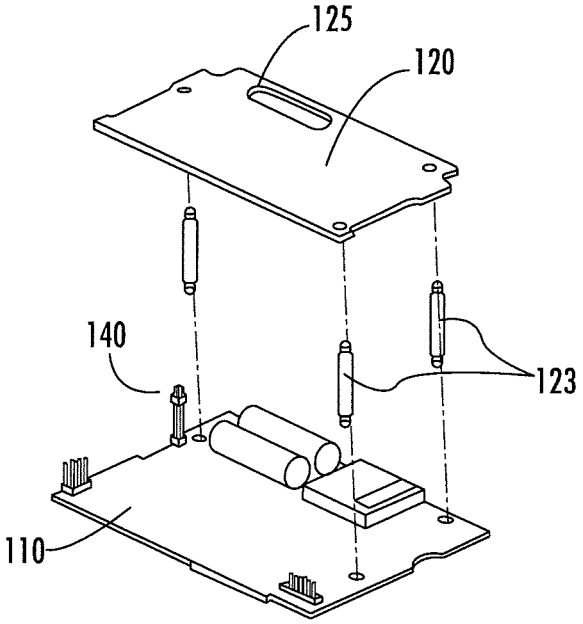
FIG. 6 is a diagram illustrating an exploded view of a hybrid patch antenna in accordance with some embodiments of the present inventive concept.

Referring now to FIG. 6, a diagram illustrating an exploded view of the antenna assembly of FIG. 5 will be discussed. As illustrated the antenna element board 120 and the radio board 110 are separated using a plurality of standoffs 123 designed to separate the board and keep them a certain distance D1 apart. As further illustrated, the antenna element board 120 and the radio board 110 are coupled by a ladder line 140 as discussed in detail above.

Figure 7:
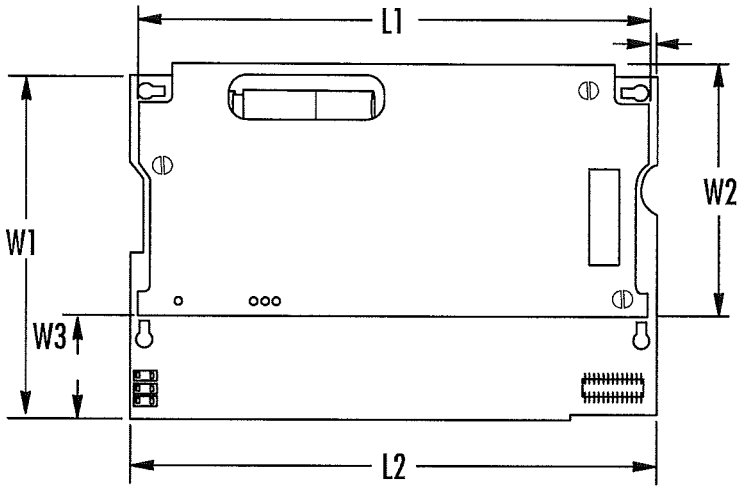
FIG. 7 is a diagram illustrating a top view of a hybrid patch antenna in accordance with some embodiments of the present inventive concept.
Figure 8:
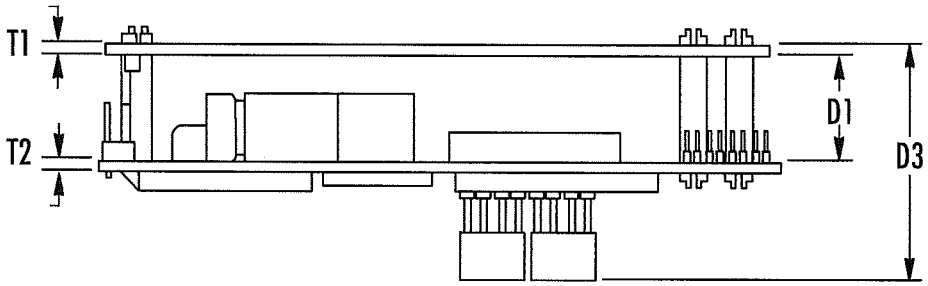
FIG. 8 is a diagram illustrating a cross section of a hybrid patch antenna in accordance with some embodiments of the present inventive concept.

Referring now to FIGS. 7 and 8, a top view and cross section of the antenna assembly of FIG. 5 will be discussed. As illustrated, in some embodiments, the antenna element board has a length L1 of about 100.6 mm; a width W2 of about 49.2 mm; and a thickness T1 of about 1.64 mm. Similarly, the radio board has a length L2 of about 103.6 mm; a width W1 of about 67 mm; and a thickness T2 of 1.575 mm. The antenna element boards are separated by the standoffs by a distance D1 of about 16 mm as discussed above. The radio board extends a width W3 of about 20.3 mm beyond an edge of the antenna element board as shown in FIG. 7. Finally, a total depth D3 of the antenna assembly including pins is about 34.96 mm. These dimensions are provided for example only.

It will be understood that FIGS. 5 through 8 illustrate an example embodiment of an antenna assembly in accordance with some embodiments of the present inventive concept. Thus, embodiments of the present inventive concept are not limited thereto. For example, the boards are depicted in FIGS. 5 through 8 including various components, more or fewer components may be provided without departing from the scope of the present inventive concept.

Figure 9:
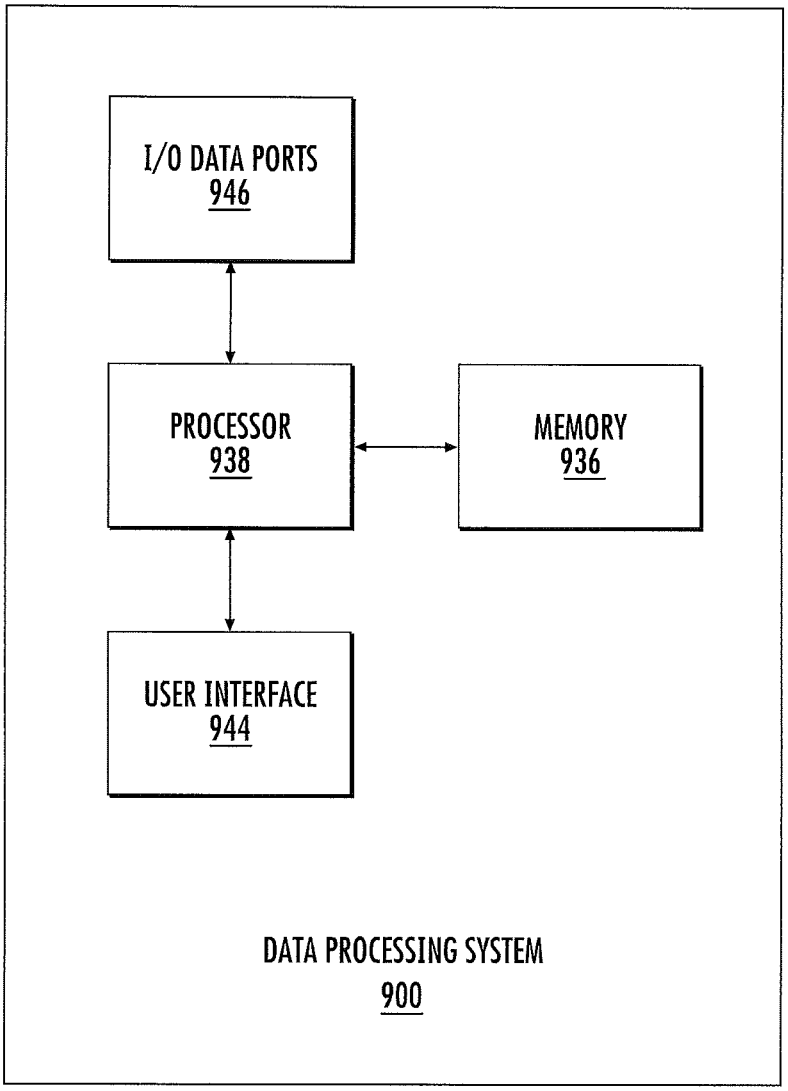
FIG. 9 is an example data processing system that may be used in accordance with some embodiments discussed herein.

Referring now to FIG. 9, an exemplary embodiment of a data processing system 900 suitable for use with smart meters in accordance with some embodiments of the present inventive concept will be discussed. For example, the data processing system may be included in a communications device at the utility that is in communication with the smart meter. The communication between the smart meter and the communications device is facilitated by the antenna positioned in the meter in accordance with embodiments discussed herein. As illustrated in FIG. 9, the data processing system includes a user interface 944 such as a display, a keyboard, keypad, touchpad or the like, I/O data ports 946 and a memory 936 that communicates with a processor 938. The I/O data ports 946 can be used to transfer information between the data processing system 900 and another computer system or a network. These components may be conventional components, such as those used in many conventional data processing systems, which may be configured to operate as described herein. This data processing system 900 may be included any type of computing device without departing from the scope of the present inventive concept. For example, the computing device may be mobile device, such as a smart phone, a tablet and the like, or a desk top device.

Example embodiments are described above with reference to block diagrams and/or flowchart illustrations of methods, devices, systems and/or computer program products. It is understood that a block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means (functionality) and/or structure for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the functions/acts specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, example embodiments may be implemented in hardware and/or in software (including firmware, resident software, micro-code, etc.). Furthermore, example embodiments may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Computer program code for carrying out operations of data processing systems discussed herein may be written in a high-level programming language, such as Java, AJAX (Asynchronous JavaScript), C, and/or C++, for development convenience. In addition, computer program code for carrying out operations of example embodiments may also be written in other programming languages, such as, but not limited to, interpreted languages. Some modules or routines may be written in assembly language or even micro-code to enhance performance and/or memory usage. However, embodiments are not limited to a particular programming language. It will be further appreciated that the functionality of any or all of the program modules may also be implemented using discrete hardware components, one or more application specific integrated circuits (ASICs), or a field programmable gate array (FPGA), or a programmed digital signal processor, a programmed logic controller (PLC), microcontroller or graphics processing unit.

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated.

In the drawings and specification, there have been disclosed exemplary embodiments of the inventive concept.

However, many variations and modifications can be made to these embodiments without substantially departing from the principles of the present inventive concept. Accordingly, although specific terms are used, they are used in a generic and descriptive sense only and not for purposes of limitation, the scope of the inventive concept being defined by the following claims.

That which is claimed is:

1. A hybrid patch antenna assembly comprising: an antenna element board comprising first and second layers separated by a dielectric; the first layer comprising an active antenna element and the second layer comprising an antenna ground; and a radio board coupled to the antenna element board by a plurality of parallel ladder line legs of a ladder line and separated from the antenna element board by a predetermined distance such that the antenna element board is suspended above the radio board; wherein a first leg of the plurality of parallel ladder line legs is an active feed and is configured to electrically connect to the active antenna element of the antenna assembly; and wherein a second leg of the plurality of parallel ladder line legs and is configured to electrically connect the radio board with the antenna ground of antenna board; wherein a width of the antenna element board is about two thirds a width of the radio board.

2. The hybrid patch antenna assembly of claim 1: wherein the first layer of the antenna element board comprises an active antenna element; and wherein the second layer of the antenna element board comprises an antenna ground, the active antenna element and the antenna ground being integrated into a single printed circuit board.

3. The hybrid patch antenna assembly of claim 2, wherein the first and second layers of the antenna element board comprise copper and the dielectric comprises FR4.

4. The hybrid patch antenna assembly of claim 1, wherein the hybrid patch antenna resonates at and is tuned for a frequency of from about 450 MHz to about 460 MHz.

5. The hybrid patch antenna assembly of claim 1, wherein a change in the predetermined distance between the antenna element board and the radio board changes parameters of the hybrid patch antenna assembly.

6. The hybrid patch antenna assembly of claim 1, wherein the ladder line is configured to be a controlled impedance transmission line.

7. The hybrid patch antenna assembly of claim 1, wherein a distance between the first and second legs and a location of an antenna feed defines an impedance of an antenna feed.

8. The hybrid patch antenna assembly of claim 1, wherein the antenna element board defines a cutout therein.

9. The hybrid patch antenna assembly of claim 1, wherein the hybrid patch antenna assembly has a width W of from about 59 mm to about 69.5 mm; a length L of from about 100.5 mm to about 103.7 mm; and a depth D of from about 16 mm to about 35 mm.

10. The hybrid patch antenna assembly of claim 1, wherein the hybrid patch antenna assembly is absent any parasitic lumped elements having the purpose of lowering a resonance of the hybrid patch antenna assembly.

11. The hybrid patch antenna assembly of claim 1, the hybrid patch antenna assembly is positioned in a power meter.

12. The hybrid patch antenna assembly of claim 1, wherein a third and fourth leg of the plurality of parallel ladder line legs are passive.

13. The hybrid patch antenna assembly of claim 1, wherein an antenna element board and the radio board have similar lengths, a length of the radio board being slightly longer than a length of the antenna element board.

14. The hybrid patch antenna assembly of claim 13, wherein a total depth of the hybrid patch antenna assembly is about 35 mm.

15. A smart power meter comprising a hybrid patch antenna assembly, the hybrid patch antenna assembly comprising: an antenna element board comprising first and second layers separated by a dielectric; the first layer comprising an active antenna element and the second layer comprising an antenna ground; and a radio board coupled to the antenna element board by a plurality of parallel ladder line legs of a ladder line and separated from the antenna element board by a predetermined distance such that the antenna element board is suspended above the radio board; wherein a first leg of the plurality of parallel ladder line legs is an active feed and is configured to electrically connect to the active antenna element of the antenna assembly; and wherein a second leg of the plurality of parallel ladder line legs and is configured to electrically connect the radio board with the antenna ground of antenna board; wherein a width of the antenna element board is about two thirds a width of the radio board.

16. The meter of claim 15: wherein the active antenna element and the antenna ground being integrated into a single printed circuit board.

17. The meter of claim 16, wherein the first and second layers of the antenna element board comprise copper and the dielectric comprises FR4.

* * * * *